US010656554B2

(12) United States Patent
Taniguchi et al.

(10) Patent No.: US 10,656,554 B2
(45) Date of Patent: May 19, 2020

(54) IMAGE FORMING APPARATUS

(71) Applicant: CANON KABUSHIKI KAISHA, Tokyo (JP)

(72) Inventors: Hisashi Taniguchi, Suntou-gun (JP); Shunsuke Matsushita, Yokohama (JP); Shuhei Kawasaki, Susono (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/391,012

(22) Filed: Apr. 22, 2019

(65) Prior Publication Data

US 2019/0332030 A1 Oct. 31, 2019

(30) Foreign Application Priority Data

Apr. 27, 2018 (JP) ..... 2018-087521

(51) Int. Cl.
*G03G 15/08* (2006.01)
*G03G 15/02* (2006.01)
*G03G 21/00* (2006.01)

(52) U.S. Cl.
CPC ..... *G03G 15/0808* (2013.01); *G03G 15/0216* (2013.01); *G03G 21/0011* (2013.01); *G03G 2221/0005* (2013.01)

(58) Field of Classification Search
CPC ..... G03G 15/0808; G03G 15/0216; G03G 21/0011; G03G 2221/0005
See application file for complete search history.

(56) References Cited

U.S. PATENT DOCUMENTS

2005/0019071 A1* 1/2005 Akagi ..... G03G 21/0035 399/356
2005/0047804 A1* 3/2005 Kosuge ..... G03G 15/5033 399/27
2007/0253726 A1* 11/2007 Kagawa ..... G03G 15/0216 399/100
2011/0150512 A1 6/2011 Tamagaki
2011/0150519 A1* 6/2011 Kanazawa ..... G03G 15/5008 399/71
2012/0087685 A1* 4/2012 Matsuda ..... G03G 21/0011 399/53
2016/0231689 A1* 8/2016 Tomita ..... G03G 21/00

FOREIGN PATENT DOCUMENTS

JP 2006-098729 A 4/2006
JP 2015-11979 A 1/2015
JP 2015-187707 A 10/2015

* cited by examiner

*Primary Examiner* — Ryan D Walsh
(74) *Attorney, Agent, or Firm* — Canon USA, Inc., IP Division

(57) ABSTRACT

A control unit of an image forming apparatus controls a developer supply amount per unit time in a coating agent removal sequence based on information about a driven amount of an image-bearing member unit acquired from a first memory of the image-bearing member unit via a communication unit, and information about a driven amount of a developing unit acquired from a second memory of the developing unit via the communication unit.

17 Claims, 7 Drawing Sheets

IMAGE FORMING APPARATUS

BACKGROUND OF THE INVENTION

Field of the Invention

The present invention relates to an image forming apparatus that forms an image on a recording material.

Description of the Related Art

In an image forming apparatus, such as a printer, which uses an electrophotographic image forming process, there is known a structure in which a drum cartridge and a developing cartridge are independently attachable to and detachable from the image forming apparatus. In the drum cartridge, there is known a unit that brings a cleaning member into contact with the surface of a drum to remove residual toner as a unit for removing toner remaining after a toner image formed on an image-bearing member (hereinafter referred to as a drum) is transferred onto a recording material.

As the cleaning member, a structure including an elastic body made of polyurethane rubber or other material and a support plate that supports the elastic body is widely employed.

On the other hand, the developing cartridge is provided with a development roller that blocks an opening of a toner container, which mainly contains toner, and that is disposed with a part of the development roller being exposed, and a toner amount regulating blade that comes into contact with the surface of the development roller to maintain a constant amount of toner to be conveyed.

In this case, if powder coating agent is coated as lubricant in advance on the surface of the development roller before use in order to reduce torque in an initial stage of using a new developing cartridge, the coating agent may remain on the development roller or in the development container. In that case, the coating agent and developer are mixed on the surface of the development roller, which causes a problem that a failure image in which an uneven density or a white spot (a dot-like portion where no (or little) toner is present on an image) occurs is generated in an image.

To solve this problem, Japanese Patent Application Laid-Open No. 2015-187707 discusses a coating agent discharge sequence for preventing an image failure, such as an uneven density or a white spot, by effectively discharging coating agent first onto a drum when a new developing apparatus is used.

However, in the structure in which the drum cartridge and the developing cartridge are independently attachable to and detachable from the apparatus, the following problem occurs depending on a combination of usage statuses of the cartridges when the coating agent discharge sequence is executed.

Specifically, if the coating agent discharge sequence for the developing cartridge is executed in a state where the developing cartridge is replaced with a new one while the drum cartridge is still used without being replaced, the cleaning performance of the drum cartridge deteriorates due to scratches on the drum. As a result, the coating agent or small-diameter toner particles pass through the cleaning member, which may cause a cleaning failure such as soiling of a charging roller.

SUMMARY OF THE INVENTION

According to an aspect of the present invention, an image forming apparatus including an image-bearing member unit and a developing unit that are attachable thereto and detachable therefrom, wherein the imaging bearing member unit comprises a rotatable image-bearing member on which an electrostatic latent image is formed, a cleaning member configured to come into contact with the image-bearing member to remove developer from a surface of the image-bearing member, and a first memory configured to store information about a driven amount of the image-bearing member, wherein the developing unit comprises a developer bearing member configured to supply developer to the surface of the image-bearing member to develop the electrostatic latent image into a developer image, at least a part of the developer bearing member being coated with lubricant, and a second memory configured to store information about a driven amount of the developing unit, comprises a communication unit configured to read the information stored in the first memory and the information stored in the second memory, and a control unit configured to control execution of a coating agent removal sequence for removing the lubricant from the developer bearing member, wherein the control unit controls a developer supply amount per unit time supplied from the developer bearing member in the coating agent removal sequence based on the information about the driven amount of the image-bearing member acquired from the first memory via the communication unit, and the information about the driven amount of the developing unit acquired from the second memory via the communication unit.

Further features of the present invention will become apparent from the following description of exemplary embodiments with reference to the attached drawings.

DESCRIPTION OF THE EMBODIMENTS

[Image Forming Apparatus]

Figure 1:
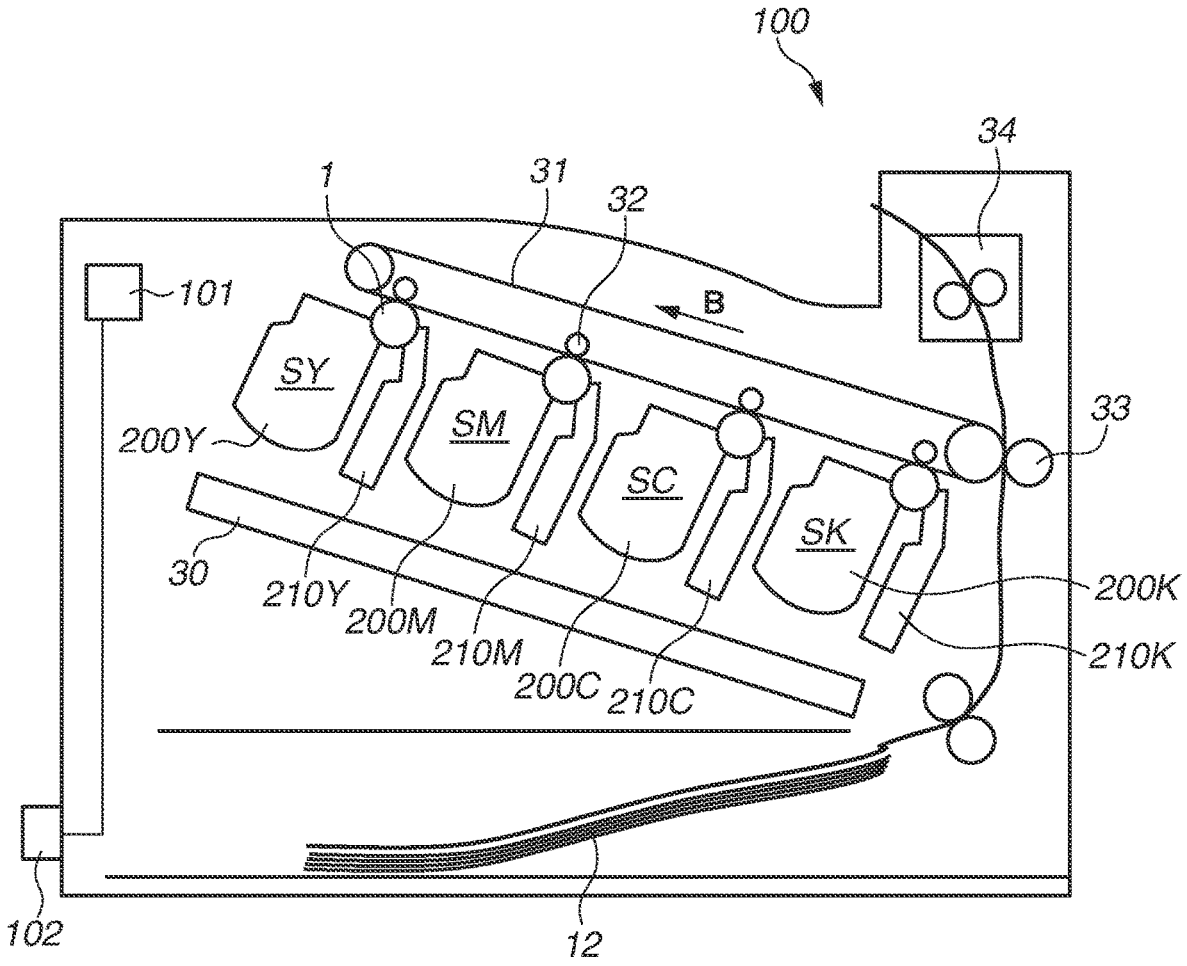
FIG. 1 is a schematic diagram illustrating an image forming apparatus according to a first exemplary embodiment.

First, an overall structure of an image forming apparatus according to a first exemplary embodiment will be described with reference to FIG. 1.

An image forming apparatus 100 according to the present exemplary embodiment is an A4 full-color laser beam printer that employs an in-line process and an intermediate transfer process, and is capable of forming, based on image information, a full-color image on a recording material (e.g., a recording paper sheet, a plastic sheet, or cloth).

The image information is input to a main body of the image forming apparatus 100 from an image reading apparatus connected to the main body of the image forming apparatus 100, or from a host apparatus such as a personal computer communicably connected to the main body of the image forming apparatus 100. The image forming apparatus 100 includes image formation units SY, SM, SC, and SK for forming images of yellow (Y), magenta (M), cyan (C), and black (K) as a plurality of image formation units. In the present exemplary embodiment, the image formation units SY, SM, SC, and SK are aligned in a direction intersecting the vertical direction.

The image formation units SY, SM, SC, and SK include drum cartridges 210 (210Y, 210M, 210C, and 210K) each serving as an image-bearing member unit, and developing cartridges 200 (200Y, 200M, 200C, and 200K) each serving as a developing unit, respectively. These units are attachable to and detachable from the image forming apparatus 100 through an attachment unit, such as an attachment guide or a positioning member, which is provided on the main body of the image forming apparatus 100. In the present exemplary embodiment, the drum cartridges 210 for each color have the same shape, and the developing cartridges 200 for each color have the same shape. The developing cartridges 200 for each color contain toner of yellow (Y), magenta (M), cyan (C), and black (K), respectively. In the present exemplary embodiment, there is described a structure in which the drum cartridges 210 and the developing cartridges 200 are independently attachable to and detachable from the image forming apparatus 100. However, a structure in which the drum cartridges 210 and the developing cartridges 200 are attachable to and detachable from the main body of the image forming apparatus 100 in an integrated manner may also be employed. Photosensitive drums 1 are each rotationally driven by a drive unit (drive source). A scanner unit (exposure apparatus) 30 is disposed at the periphery of the photosensitive drums 1. The scanner unit 30 is an exposure unit that emits laser beams based on the image information and forms an electrostatic image (electrostatic latent image) on the surface of each of the photosensitive drums 1.

In a main-scanning direction (direction orthogonal to a conveyance direction of a recording material 12), a writing of laser exposure is performed for each scanning line based on a position signal as a start point, which is called BD, corresponding to a position within a polygon scanner. On the other hand, in a sub-scanning direction (conveyance direction of the recording material 12), the writing of laser exposure is performed so as to be delayed by a predetermined time from a TOP signal with a switch (not illustrated) disposed within a conveyance path for the recording material 12 as a start point.

In this way, it is possible to constantly perform the laser exposure at the same positions on the surfaces of the photosensitive drums 1 in the four image formation units SY, SM, SC, and SK, respectively.

An intermediate transfer belt 31 serving as an intermediate transfer member for transferring toner images (developer images) formed on the photosensitive drums 1 onto the recording material 12 is disposed so as to face the four photosensitive drums 1.

The intermediate transfer belt 31 formed of an endless belt as an intermediate transfer member comes into contact with all the photosensitive drums 1, and circularly moves (rotates) in a direction (counterclockwise direction) indicated by an arrow B in FIG. 1.

On the side of the inner peripheral surface of the intermediate transfer belt 31, four primary transfer rollers 32 each serving as a primary transfer unit are arranged side by side so as to face the respective photosensitive drums 1. A bias having a polarity opposite to a regular charging polarity of toner is applied to the primary transfer rollers 32 from a primary transfer bias power supply (high-voltage power supply 512) serving as a primary transfer bias application unit (not illustrated). As a result, the toner images formed on the photosensitive drums 1 are transferred (primarily transferred) onto the intermediate transfer belt 31.

Further, a secondary transfer roller 33 serving as a secondary transfer unit is disposed on the side of the outer peripheral surface of the intermediate transfer belt 31.

A bias having a polarity opposite to the regular charging polarity of the toner is applied to the secondary transfer roller 33 from a secondary transfer bias power supply (high-voltage power supply 512) serving as a secondary transfer bias application unit (not illustrated).

In this way, the toner images of four colors formed on the intermediate transfer belt 31 are transferred (secondarily transferred) onto the recording material 12.

For example, in the case of forming a full-color image, the above-described processes are sequentially performed by the image formation units SY, SM, SC, and SK, and toner images of the respective colors are sequentially superimposed and primarily transferred onto the intermediate transfer belt 31. After that, the recording material 12 is conveyed to the secondary transfer unit in synchronization with the movement of the intermediate transfer belt 31. Then, by the action of the secondary transfer roller 33, which is in contact with the intermediate transfer belt 31 via the recording material 12, the toner images of four colors formed on the intermediate transfer belt 31 are secondarily transferred collectively onto the recording material 12. The recording material 12 onto which the toner images have been transferred is conveyed to a fixing device 34 serving as a fixing unit. When the recording material 12 is heated and pressed in the fixing device 34, the toner images are fixed onto the recording material 12.

[Drum Cartridge]

Figure 2:
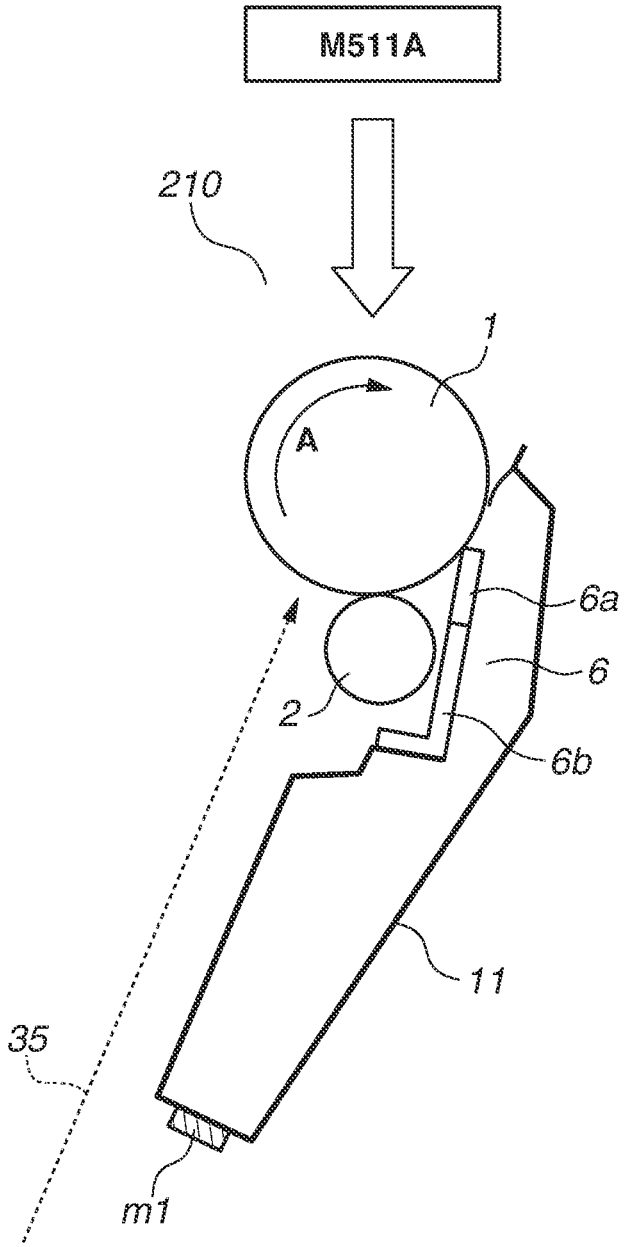
FIG. 2 is a schematic diagram illustrating a drum cartridge illustrated in FIG. 1.

Next, the structure of one of the above-described drum cartridges 210 will be described, as a representative example. FIG. 2 is a section view (principal section) of the drum cartridge 210 according to the present exemplary embodiment as viewed along a longitudinal direction (rotational axis direction) of the photosensitive drum 1.

The photosensitive drum 1 is rotatably attached to the drum cartridge 210 via a bearing (not illustrated). By receiving a driving force from a drive motor M511A serving as a drive unit, the photosensitive drum 1 is rotationally driven in a direction indicated by an arrow A in FIG. 2 together with an image forming operation. In the present exemplary embodiment, the drum cartridge 210 has a diameter of 24 mm and rotates at a speed of 200 mm/seconds, but other values of diameter and speed are possible.

The drum cartridge 210 is provided with a cleaning blade 6 (clearing member) in such a manner that the cleaning blade 6 comes into contact with the surface of the photosensitive drum 1 in a rotating state, and a charging roller 2. The cleaning blade 6 serves as a contact member and is formed of an elastic body.

A bias enough to cause any charge to be given on the photosensitive drum 1 is applied to the charging roller 2 from a charging bias power supply (high-voltage power supply 512) serving as a charging bias application unit. In the present exemplary embodiment, the applied bias is set in such a manner that a potential (charged potential: Vd) on the photosensitive drum 1 becomes −500 V.

The scanner unit 30 emits laser light 35 based on the image information to form an electrostatic image (electrostatic latent image) on the surface of the photosensitive drum 1. As a light irradiation device for forming an electrostatic latent image on the surface of the photosensitive drum 1, not only the scanner unit 30, but also a light-emitting diode (LED) array in which a large number of LED elements are arranged in an array may be used.

The cleaning blade 6 is integrally formed in such a manner that a rubber blade 6*a* is supported by a cleaning support plate 6*b*. As the rubber blade 6*a*, for example, polyurethane rubber having a thickness of 2 mm and an MD-1 hardness of 60° to 80° under an environment of 23° C. is used.

The cleaning blade 6 is fixed to a drum cartridge frame 11, and is disposed in such a manner that a leading edge of the rubber blade 6*a* comes into contact with the photosensitive drum 1. In the cleaning blade 6, the leading edge of the free end of the rubber blade 6*a* scrapes off the residual toner that has not been transferred onto the intermediate transfer belt 31 and remains on the surface of the photosensitive drum 1.

The toner scraped off by the cleaning blade 6 (the toner is hereinafter referred to as waste toner) is stored in the drum cartridge frame 11. Part of the waste toner is accumulated on the leading edge of the free end of the rubber blade 6*a* and provides a lubricating property between the photosensitive drum 1 and the rubber blade 6*a*, thereby stabilizing a cleaning performance.

The drum cartridge 210 is also provided with a nonvolatile memory m1 (hereinafter, referred to as an "O memory m1") serving as a first memory.

The O memory m1 stores information about a driven amount of the photosensitive drum 1, such as the number of rotations of the photosensitive drum 1. The driven amount described herein refers to a cumulative driven amount. The information about the driven amount acquired from the memory is not limited to the cumulative driven amount, but instead, for example, a remaining drivable amount, may be used. In this case, for example, the remaining drivable amount of 100% corresponds to the cumulative driven amount of 0%. Various parameters, such as a photosensitive drum electrification time, a total wear amount on the surface of the photosensitive drum, and the number and prints, can be used, as long as the parameters are correlated with the driven amount of the photosensitive drum 1. In addition, information with which the type of the drum cartridge 210, such as the manufacturing number or model name of the drum cartridge 210, can be identified is stored.

A control unit 101 can recognize the amount of driving, such as how long the drum cartridge 210 is used, or how long the drum cartridge 210 is operated, based on the information stored in the O memory m1.

The O memory m1 is configured to communicate (write or read information) with the control unit 101 of the image forming apparatus 100 illustrated in FIG. 1 in a non-contact manner, or in a contact manner via an electrical contact.

[Developing Cartridge]

Figure 3:
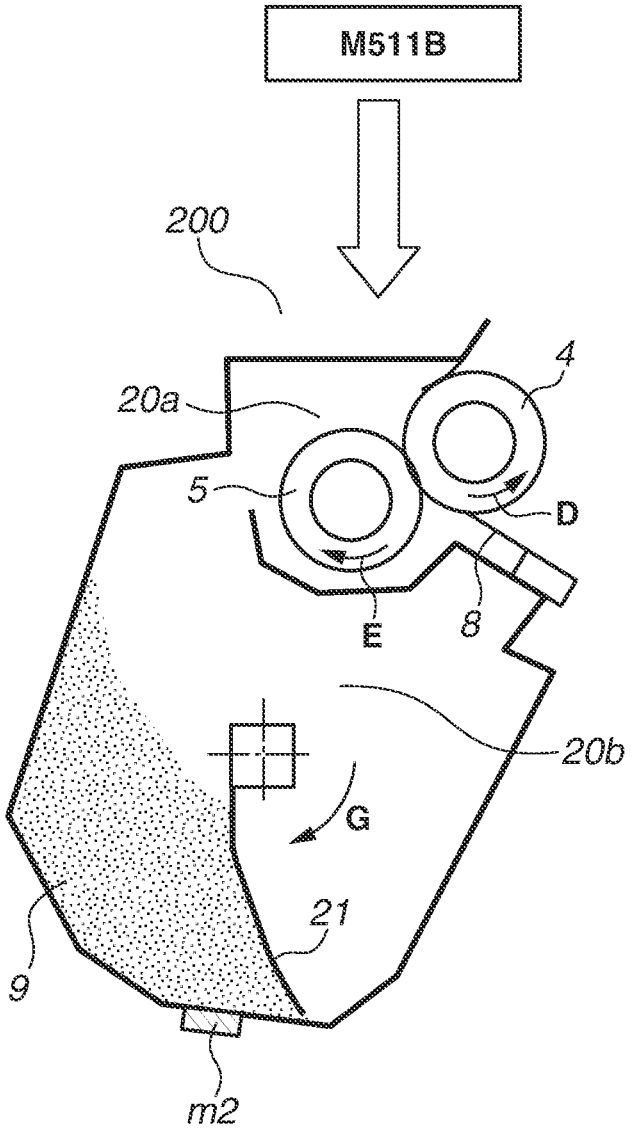
FIG. 3 is a schematic diagram illustrating a developing cartridge illustrated in FIG. 1.

Next, the structure of one of the developing cartridges 200 to be attached to the image forming apparatus 100 will be described, as a representative example. FIG. 3 is a section view (principal section) of the developing cartridge 200 according to the present exemplary embodiment as viewed along the longitudinal direction (rotational axis direction) of a development roller 4.

The developing cartridge 200 includes a developing chamber 20*a* and a developer storage chamber 20*b*. The developer storage chamber 20*b* is disposed below the developing chamber 20*a*. Toner 9 serving as developer is contained in the developer storage chamber 20*b*. In the present exemplary embodiment, a negative polarity is used as the regular charging polarity of the toner 9. The case of using negative charging toner will be described below. The present exemplary embodiment is not limited to the case of using negative charging toner, but also can be applied to a case of using positive charging toner.

The developer storage chamber 20*b* is provided with a developer conveyance member 21 that conveys the toner 9 to the developing chamber 20*a*. The developer conveyance member 21 rotates in a direction indicated by an arrow G in FIG. 3 to convey the toner 9 to the developing chamber 20*a*.

The developing chamber 20*a* is provided with the development roller 4 serving as a developer bearing member. The development roller 4 contacts the photosensitive drum 1, and by receiving a driving force from a drive motor M511B serving as a development drive unit, the development roller 4 rotates in a direction indicated by an arrow D in FIG. 3.

In the present exemplary embodiment, the development roller 4 and the photosensitive drum 1 rotate in such a manner that the surfaces of the development roller 4 and the photosensitive drum 1 move in the same direction at an opposing portion (contact portion), and the development roller 4 rotates 150% faster than the photosensitive drum 1. The development roller 4 and the photosensitive drum 1 may rotate in such a manner that the surfaces of the development roller 4 and the photosensitive drum 1 move in opposite directions at the opposed portion (contact portion).

Figure 4:
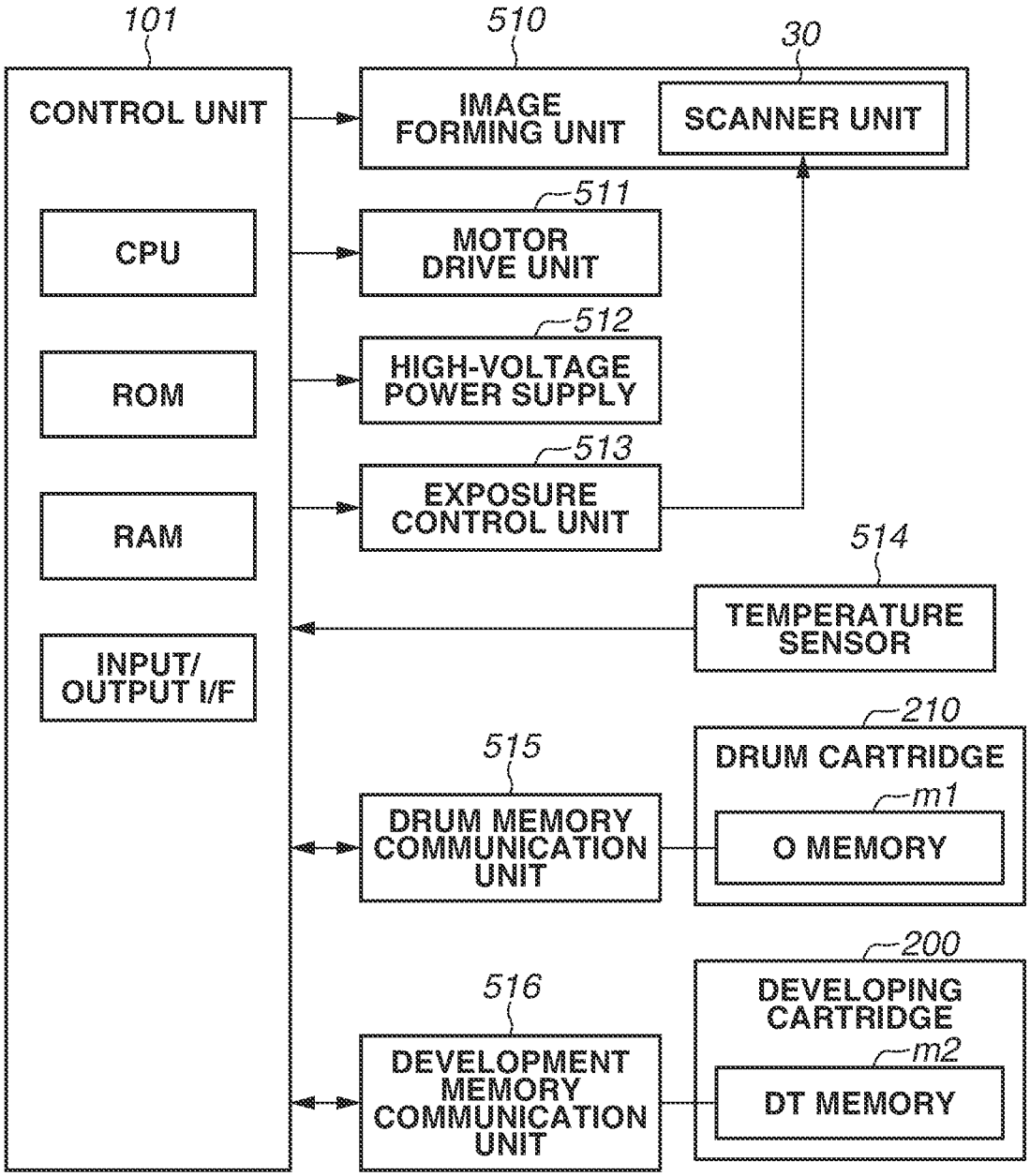
FIG. 4 is a control block diagram illustrating the image forming apparatus according to the first exemplary embodiment.

A bias enough to develop and visualize an electrostatic latent image formed on the photosensitive drum 1 as a toner image is applied to the development roller 4 from the high-voltage power supply 512 to be described below with reference to FIG. 4 and serves as a development roller bias application unit.

Further, in the developing chamber 20*a*, a toner supply roller (hereinafter referred to simply as a "supply roller") 5 and a toner amount regulating member (hereinafter referred to simply as a "regulating member") 8 are disposed. The supply roller 5 supplies toner conveyed from the developer storage chamber 20*b* to the development roller 4. The regulating member 8 regulates the coating amount of the toner on the development roller 4 supplied by the supply roller 5, and applies charges.

The developing cartridge 200 is also provided with a nonvolatile memory (hereinafter, referred to as a "DT memory m2") serving as a second memory. The DT memory m2 stores the number of rotations of the development roller 4 and the like. The driven amount of the developing cartridge 200 can be recognized based on the information stored in the DT memory m2. The information stored in the DT memory m2 and used to recognize the driven amount of the developing cartridge 200 is not limited to the number of rotations of the development roller 4. For example, various parameters, such as the number of rotations of the developer conveyance member 21, a toner remaining amount, a toner use amount (obtained by counting pixels), can be used as long as the values have a correlation with the number of rotations of the development roller 4.

Similar to the O memory m1, the DT memory m2 is configured to communicate (write or read information) with the control unit 101 of the image forming apparatus 100 in a non-contact manner, or in a contact manner via an electrical contact.

Further, lubricant is coated on the development roller 4, thereby suppressing the friction caused between the development roller 4 and the supply roller 5, or between the development roller 4 and the regulating member 8, when a new developing cartridge 200 is used. In this way, torque necessary for driving the developing cartridge 200 can be reduced. However, if the lubricant and the toner are mixed on the development roller 4 and the image formation is carried out in this state, the following problem occurs, which may lead to a deterioration in image quality.

If the lubricant and the toner are mixed on the development roller 4, the toner is given charges while being friction-charged by the rubbing with the regulating member 8, and is also given charges by being rubbed with the lubricant.

Accordingly, the charge amount of the toner is extremely large compared to that when the lubricant and the toner are not mixed. As a result, a difference occurs in the charge amount of toner between a portion where the lubricant and the toner are mixed and a portion where the lubricant and the toner are not mixed, which causes a difference in the developing performance for the same latent image potential.

As a result, in a case of printing a whole black image, density unevenness occurs in a wide range within the image. This problem is more likely to occur when the lubricant coated on the development roller 4 in the initial stage cannot be sufficiently removed. In a case of printing a whole black image in a state where lubricant is present on only a part of the surface of the development roller 4, a difference in the developing performance appears in only a part of the surface of the development roller 4. Accordingly, a white spot image (an image in which a portion where no (or little) toner is present on the recording medium (or only a small amount of toner is formed) appears as a spot) is formed. This problem is more likely to occur, for example, when the lubricant collected in the supply roller 5, the developing chamber 20*a*, or the like is supplied onto the surface of the development roller 4 again.

In this manner, when the lubricant remains on the surface of the development roller 4, an image defect may occur. Accordingly, it is necessary to execute a sequence for immediately removing the lubricant coated on the development roller 4 from the surface of the development roller 4 and discharging the lubricant to the outside of the developing device 3 after the use of the developing cartridge is started.

[Configuration of Lubricant]

The lubricant coated on the development roller 4 at the time of shipment of the cartridge will now be described. In the present exemplary embodiment, silicone resin particles (product name: Tospearl 120 manufactured by GE Toshiba Silicones Co. Ltd. and having an average grain size of 2 μm) were used as the lubricant.

The Tospearl 120 has the charging property of charging to a negative side, and shows a negative polarity higher than that of toner. In other words, this lubricant has the same polarity as the charging polarity of developer, and the absolute value of the charge amount per unit mass of the lubricant is greater than the absolute value of the charge amount per unit mass of the developer.

The type of the lubricant is not limited to silicone resin particles described above.

[Measurement of Charge Amount]

When the charge amount of each of the developer and the lubricant used in the present exemplary embodiment was measured by, for example, a predetermined measurement method discussed in Japanese Patent Application Laid-Open No. 2015-11979, the charge amount of the developer was −84 μC/g and the charge amount of the lubricant was −196 μC/g.

In other words, the lubricant is charged to the same polarity (negative polarity) as that of the developer, and the absolute value of the charge amount per unit mass of the lubricant is greater than the absolute value of the charge amount per unit mass of the developer. In the present exemplary embodiment, there is described an example in which silicone resin particles (product name: Tospearl 120 manufactured by GE Toshiba Silicones Co. Ltd. and having an average grain size of 2 μm) were used as the lubricant. However, the present invention is not limited to this example.

[Block Diagram]

Next, a control block diagram of the image forming apparatus 100 will be described with reference to FIG. 4.

The control unit 101 includes a central processing unit (CPU), which is a central element that performs arithmetic processing, memories, such as a read-only memory (ROM) and a random access memory (RAM), each serving as a storage unit, and an input/output interface (I/F) for inputting information from a peripheral device and outputting information to the peripheral device.

The RAM stores detection results of sensors, calculation results, and the like, and the ROM stores control programs and data tables preliminarily obtained.

The control unit 101 is a control unit that controls the operation of the image forming apparatus 100 in an integrated manner Control targets in the image forming apparatus 100 are connected via the input/output I/F.

An image forming unit 510 is a generic term for the drum cartridge 210, the scanner unit 30, the intermediate transfer belt 31, the secondary transfer roller 33, the fixing device 34, and the like described above with reference to FIG. 1, and forms an image writing position and an image pattern.

A motor drive unit 511 refers to various motors, and is a power source for rotationally driving the polygon scanner, the photosensitive drum 1, the development roller 4, and other components. The motor drive unit 511 operates based on a control signal supplied from the control unit 101. For example, the motor M511A illustrated in FIG. 2 and the motor M511B illustrated in FIG. 3 are motors to be driven. The motors M511A and M511B start to rotate for image formation in response to the start of print job input in the image forming apparatus 100 and stop the rotation in response to the completion of the print job. The high-voltage power supply 512 is a power supply that supplies a high voltage to the photosensitive drum 1, the charging roller 2, the development roller 4, the primary transfer roller 32, the secondary transfer roller 33, the fixing device 34, and the like.

An exposure control unit 513 transmits, to the scanner unit 30, a signal indicating a light quantity of laser light to be radiated on the photosensitive drum 1.

An environment sensor 514 uses sensors, which are included in the image forming apparatus 100 and measure the temperature and humidity, to transmit information indicating the temperature and humidity to the control unit 101.

Further, the control unit 101 performs data communication with the O memory m1 and the DT memory m2 via a drum memory communication unit 515 and a development memory communication unit 516, respectively, and uses the obtained data to determine the driven amount of each of the drum cartridge 210 and the developing cartridge 200.

The control unit 101 determines a process speed, a discharge amount, a discharge pattern, and the like in a new cartridge detection sequence based on the information acquired from the environment sensor 514, the O memory m1, and the DT memory m2. Further, the control unit 101 controls exchange of various electrical information signals, a drive timing, and the like, and controls processing in a flowchart to be described below, and the like. The process speed described herein corresponds to a movement speed at the contact portion when the photosensitive drum 1 and the intermediate transfer belt 31 move in the same direction at the same speed at the contact portion where the photosensitive drum 1 and the intermediate transfer belt 31 contact each other. Alternatively, when the photosensitive drum 1 and the intermediate transfer belt 31 move at different speeds at the contact position, the speed of the intermediate transfer belt 31 may be used as the process speed.

[Outline of Coating Agent Removal Sequence]

Figure 5:
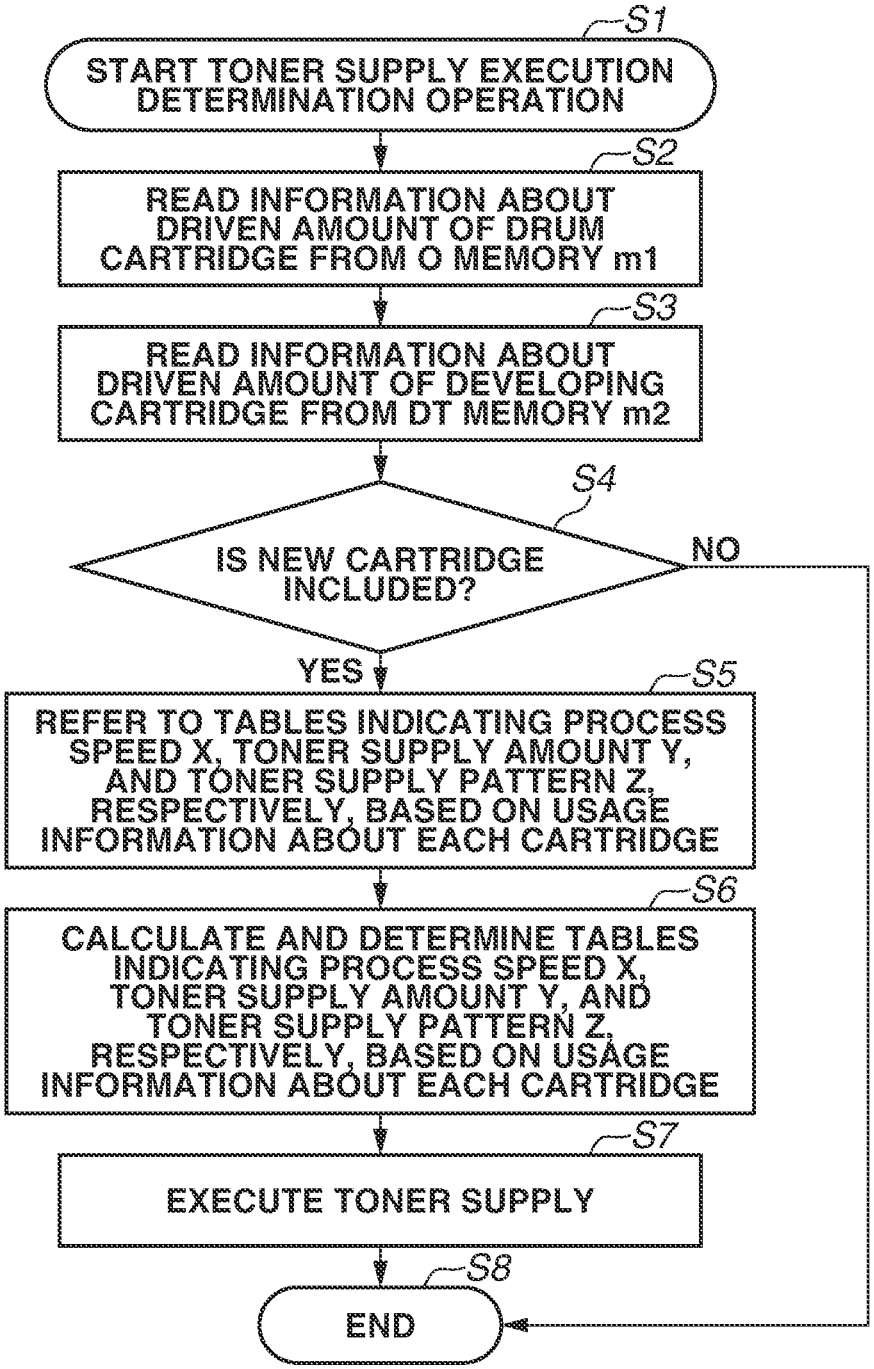
FIG. 5 is a flowchart illustrating a coating agent removal sequence according to the first exemplary embodiment.

Next, an outline of a coating agent removal sequence in the image forming apparatus 100 according to the present exemplary embodiment will be described with reference to FIG. 5. FIG. 5 is a flowchart illustrating an operation of the image forming apparatus 100 to remove the coating agent on the surface of the development roller 4 when the developing cartridge 200 is new.

First, when the image forming apparatus 100 is powered ON, or when a cartridge replacement panel is opened and then closed to be ready for operation, in step S1, the image forming unit 510 starts an execution determination operation in the coating agent removal sequence based on a command from the control unit 101.

In step S2, the control unit 101 communicates with the O memory m1, which is mounted on the drum cartridge 210, via the drum memory communication unit 515, and reads the information (cumulative driven amount) about the driven amount of the drum cartridge 210.

Next, in step S3, the control unit 101 communicates with the DT memory m2, which is mounted on the developing cartridge 200, via the development memory communication unit 516, and reads the information (cumulative driven amount) about the driven amount of the developing cartridge 200.

In step S4, the control unit 101 determines whether the drum cartridge 210 and the developing cartridge 200 include a new cartridge based on the information about the driven amount of the drum cartridge 210 and the information about the driven amount of the developing cartridge 200. More specifically, when the information about the driven amount indicates a non-driven state, the control unit 101 determines that the target cartridge is new. In the case where the control unit 101 determines whether the cartridge is new, for example, the O memory m1 and the DT memory m2 may be provided with an area for storing a new cartridge flag, and when the new cartridge flag indicates "0", it may be determined that the cartridge is new. If the cartridge is used as a target to be driven at least once, the control unit 101 rewrites the new cartridge flag with "1".

If the control unit 101 determines that no new cartridge is included (NO in step S4), the processing proceeds to step S8. In step S8, the coating agent removal sequence is terminated and the processing shifts to an image forming process.

If the control unit 101 determines that a new cartridge is included in step S4 (YES in step S4), the processing proceeds to step S5. In step S5, the control unit 101 refers to Table 1, Table 2, and Table 3 based on the information about the driven amount of the drum cartridge 210 and the information about the driven amount of the developing cartridge 200. Assume that Table 1, Table 2, and Table 3 are preliminarily stored in the ROM of the control unit 101.

TABLE 1 units: mm/seconds

| Process speed X | | Cumulative driven amount of drum cartridge 0% | 20% | 40% | 60% | 80% |
|---|---|---|---|---|---|---|
| Cumulative driven amount of developing cartridge | 0% | 200 | 150 | 100 | 50 | 50 |
| | 20% | 200 | 200 | 200 | 200 | 200 |
| | 40% | 200 | 200 | 200 | 200 | 200 |
| | 60% | 200 | 200 | 200 | 200 | 200 |
| | 80% | 200 | 200 | 200 | 200 | 200 |

TABLE 2 units: mg

| Toner supply amount (total amount) Y | | Cumulative driven amount of drum cartridge 0% | 20% | 40% | 60% | 80% |
|---|---|---|---|---|---|---|
| Cumulative driven amount of developing cartridge | 0% | 30 | 30 | 30 | 30 | 30 |
| | 20% | 42 | 38 | 34 | 30 | 30 |
| | 40% | 54 | 50 | 46 | 42 | 42 |
| | 60% | 66 | 62 | 58 | 54 | 50 |
| | 80% | 78 | 74 | 70 | 66 | 62 |

TABLE 3 units: number of divided areas

| Toner supply pattern Z | | Cumulative driven amount of drum cartridge 0% | 20% | 40% | 60% | 80% |
|---|---|---|---|---|---|---|
| Cumulative driven amount of developing cartridge | 0% | 1 | 10 | 10 | 10 | 10 |
| | 20% | 1 | 10 | 10 | 10 | 10 |
| | 40% | 1 | 10 | 10 | 10 | 10 |
| | 60% | 1 | 10 | 10 | 10 | 10 |
| | 80% | 1 | 10 | 10 | 10 | 10 |

According to Table 1, the process speed X used in the coating agent removal sequence is determined based on the cumulative driven amount of the developing cartridge 200 and the cumulative driven amount of the drum cartridge 210.

According to Table 2, the total toner supply amount Y (total developer supply amount Y) is determined based on the cumulative driven amount of the developing cartridge 200 and the cumulative driven amount of the drum cartridge 210. Table 2 indicates a state where the total developer supply amount in the coating agent removal sequence increases as the information about the driven amount of the developing cartridge 200 acquired from the second memory m2 indicates a larger cumulative driven amount. Further, the control unit 101 reduces the degree of increase described above as the information about the driven amount of the drum cartridge 210 acquired from the first memory m1 indicates a larger cumulative driven amount.

According to Table 3, the toner supply pattern Z is determined based on the cumulative driven amount of the developing cartridge 200 and the cumulative driven amount of the drum cartridge 210. The cumulative driven amount of the drum cartridge 210 and the cumulative driven amount of the developing cartridge 200 correspond to the information acquired by the control unit 101 in step S2 and the information acquired by the control unit 101 in step S3, respectively.

In step S6, the control unit 101 determines the process speed X, the toner supply amount Y, and the toner supply pattern Z based on the reference performed in step S5. The toner supply pattern Z is a parameter indicating how many parts of the areas obtained by dividing the entire surface of the development roller 4 correspond to the area in which a toner pattern is formed in one turn of the development roller 4. For example, when Z=10, a developer image to be supplied only to the surface corresponding to one of the area obtained by dividing the surface corresponding to one turn of the development roller into 10 areas is formed.

In a case where the control unit 101 determines various settings, the settings are not limited to table formats, such as Table 1, Table 2, and Table 3. For example, the control unit 101 may obtain the setting values through calculations by inputting the information obtained in steps S1 and S2 into arithmetic expressions preliminarily stored in the ROM.

For example, when the drum cartridge 210 is new (driven amount of 0%) and the developing cartridge 200 is new (driven amount of 0%), the toner supplying processing is executed at a process speed of 200 mm/s and a toner supply amount of 30 mg, and by not dividing the toner supply pattern (whole black pattern).

On the other hand, when the drum cartridge 210 is not new (driven amount of 40%) and the developing cartridge 200 is new (driven amount of 0%), the toner supplying processing is executed at a process speed of 100 mm/s and a toner supply amount of 30 mg, and by dividing the toner supply pattern into 10 areas (whole black pattern).

A case where the toner supply pattern is divided into 10 areas will now be described. First, the control unit 101 equally divides the surface corresponding to one turn of the development roller into 10 areas and assigns the areas with numbers, respectively, thereby controlling ON/OFF of the laser light amount. This indicates that the coating agent and the developer to be coated on the surface corresponding to one turn of the development roller 4 are divided and developed in such a manner that, a first area is used for a first turn of the development roller 4, a second area is used for a second turn of the development roller 4, . . . , and a tenth area is used for a tenth turn of the development roller 4. By dividing the entire surface of the development roller 4 in this manner, the toner supply amount per unit time can be reduced in terms of macro-structure. In this way, even in a state where the cleaning performance of the drum cartridge 210 deteriorates, the occurrence of a cleaning failure of the drum cartridge 210 can be suppressed while density unevenness or a white spot on the developing cartridge 200 can be suppressed.

Referring back to the flowchart of FIG. 5, in step S7, the control unit 101 then controls the image forming unit 510 and the peripheral devices (e.g., motor drive unit 511, high-voltage power supply 512) under the condition determined in step S6, and executes the toner supply process as the coating agent removal sequence.

In step S8, after executing the toner supply process, the control unit 101 causes the photosensitive drum 1 to rotate for a predetermined time, and then terminates the coating agent removal sequence.

The toner supply amount per unit time on the cleaning member is represented by the following expression. The toner supply amount per unit time=((k×X)÷DL)×(1/Z)×y where X: a process speed k: a peripheral speed ratio (rotation speed of the development roller 4/rotation speed of photosensitive drum 1)

DL: a length of one turn of the development roller 4 (e.g., 36 mm)

Z: how many of the areas obtained by dividing the entire surface of the development roller 4 correspond to the area in which a toner pattern is formed in one turn of the development roller 4 y: a supply amount of toner to be supplied in one turn of the development roller 4 (e.g., 30 mg)

Y: a total toner supply amount in a toner supply process (total developer supply amount)

Table 4 illustrates a list of toner supply amounts per unit time depending on a combination of a drum cartridge drive status (cumulative driven amount) and a developing cartridge drive status (cumulative driven amount).

TABLE 4 units: mg/seconds

| Toner supply amount per unit time (discharge amount) | | Driven amount of drum cartridge 0% | 20% | 40% | 60% | 80% |
|---|---|---|---|---|---|---|
| Driven amount of developing cartridge | 0% | 250 | 18.75 | 12.5 | 6.25 | 6.25 |
| | 20% | 250 | 25 | 25 | 25 | 25 |
| | 40% | 250 | 25 | 25 | 25 | 25 |
| | 60% | 250 | 25 | 25 | 25 | 25 |
| | 80% | 250 | 25 | 25 | 25 | 25 |

Table 4 indicates a state where the total toner supply amount per unit time in the coating agent removal sequence decreases as the information acquired from the first memory (m1) indicates a larger cumulative driven amount of the drum cartridge 210. In other words, the control unit 101 controls the image forming unit 510 to obtain the above-described state.

Further, Table 5 indicates a time required for the coating agent removal sequence depending on a combination of the driven status of the drum cartridge 210 and the drive status of the developing cartridge 200.

TABLE 5

| Time required for toner supply process | | Cumulative driven amount of drum cartridge 0% | 20% | 40% | 60% | 80% |
|---|---|---|---|---|---|---|
| Cumulative driven amount of developing cartridge | 0% | 0.12 | 1.6 | 2.4 | 4.8 | 4.8 |
| | 20% | 0.168 | 1.52 | 1.36 | 1.2 | 1.2 |
| | 40% | 0.216 | 2 | 1.84 | 1.68 | 1.68 |
| | 60% | 0.264 | 2.48 | 2.32 | 2.16 | 2 |
| | 80% | 0.312 | 2.96 | 2.8 | 2.64 | 2.48 |

As described above, if the coating agent removal sequence as described above is executed based on the combination of the cumulative driven amount of the drum cartridge 210 and the cumulative driven amount of the developing cartridge 200, the toner supply amount per unit time on the cleaning member can be appropriately controlled. In this way, the coating agent can be favorably removed while a stable cleaning state is maintained.

[Bias Control and Control of Light Quantity of Laser Light]

The bias control between the development roller 4 and the supply roller 5 in the coating agent removal sequence and the control of the light quantity of the laser light 35 to be radiated on the photosensitive drum 1 will now be described in detail.

Figure 6A:
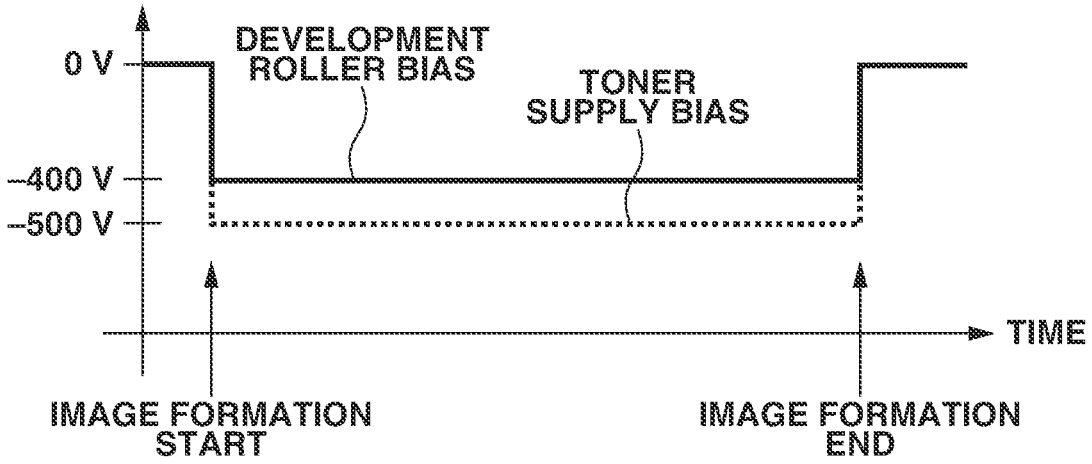
FIGS. 6A and 6B are timing charts each illustrating a state of image formation according to the first exemplary embodiment.
Figure 6B:
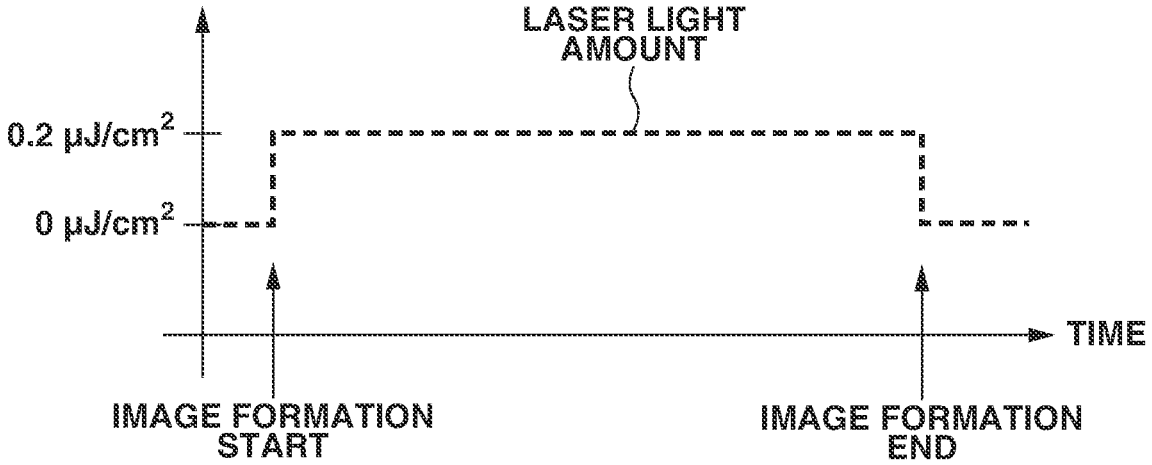

FIG. 6A is a timing chart illustrating biases to be applied respectively to the development roller 4 and the supply roller 5 in the process of image formation. FIG. 6B is a timing chart illustrating the control of the light quantity of the laser light 35 at each position in the direction (sub-scanning direction) perpendicular to the main-scanning direction of the laser light 35 when a whole black image is printed.

Figure 7A:
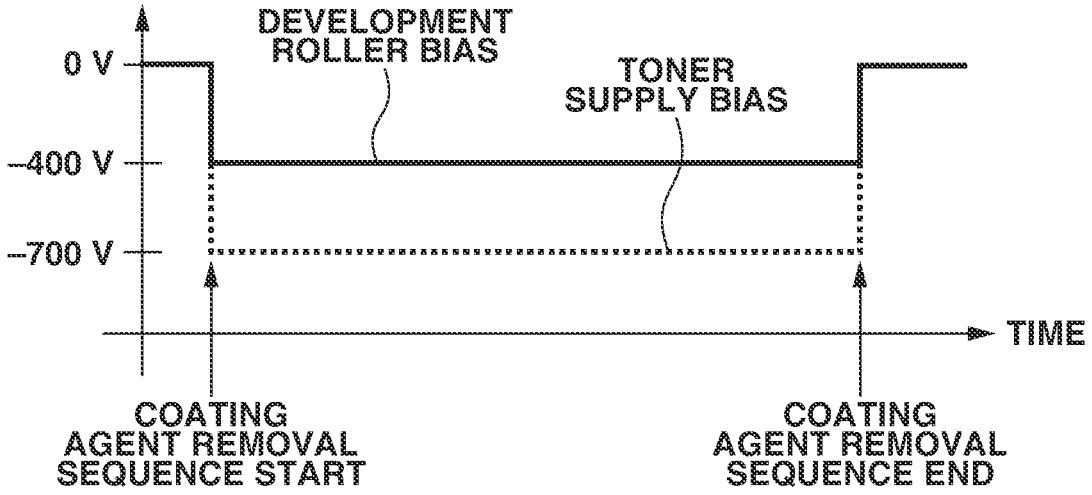
FIGS. 7A and 7B are timing charts each illustrating the coating agent removal sequence according to the first exemplary embodiment.
Figure 7B:
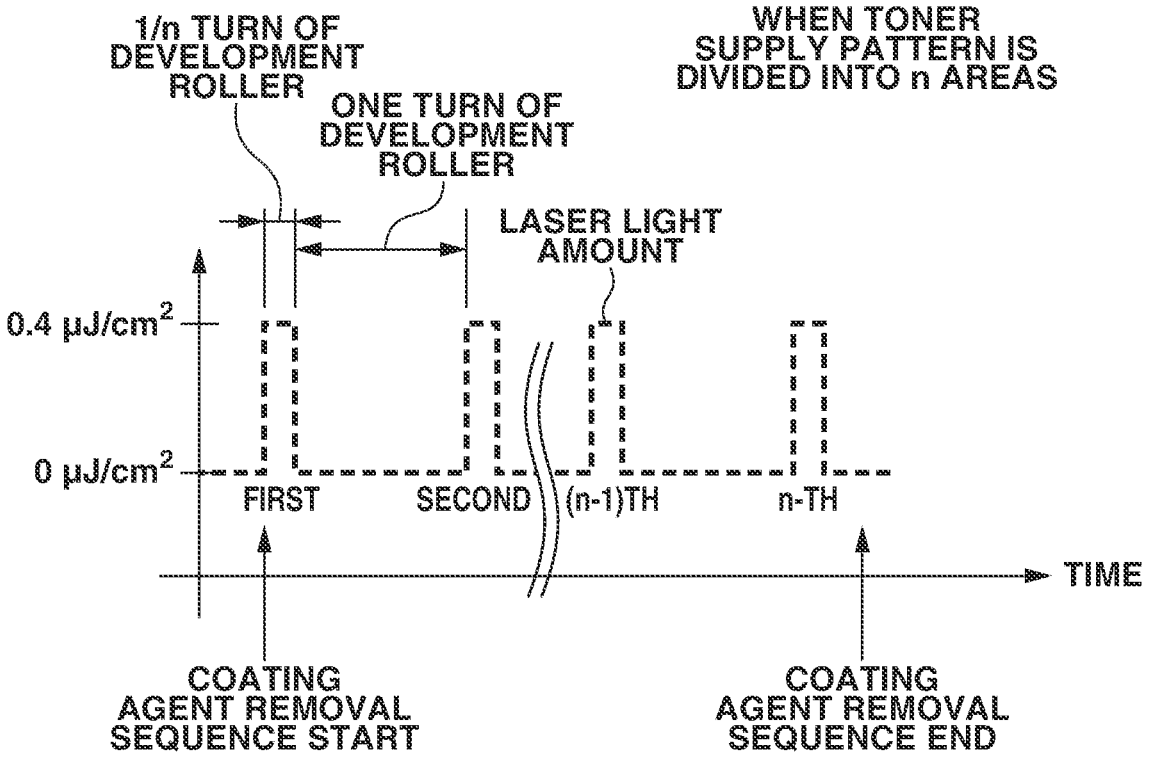

FIG. 7A is a timing chart illustrating biases to be applied respectively to the development roller 4 and the supply roller 5 during the coating agent removal sequence. FIG. 7B is a timing chart illustrating the control of the light quantity of the laser light 35 at each position in the direction perpendicular to the main-scanning direction of the laser light 35 during the coating agent removal sequence.

As illustrated in FIG. 6A, a potential difference between the development roller 4 and the supply roller 5 in the process of image formation is set to 100 V. This value is set so as to prevent the amount of toner to be supplied to the development roller 4 from being insufficient or excessive.

The light quantity of the laser light 35 is set in consideration of the image quality and character quality, and as illustrated in FIG. 6B, the light quantity is controlled to be constant in both the main-scanning direction and the sub-scanning direction from the start of image formation until the end of image formation.

On the other hand, as illustrated in FIG. 7A, during the coating agent removal sequence, the potential difference between the development roller 4 and the supply roller 5 is set to be larger than that during the process of image formation so as to prevent the coating agent from being transferred from the development roller 4 onto the supply roller 5. In the present embodiment, for example, −400 V is applied to the development roller 4 and −700 V is applied to the supply roller 5. This configuration prevents the coating agent having a negative charging property from moving to the supply roller 5 from the development roller 4.

Next, an operation for controlling the quantity of the laser light 35 in the coating agent removal sequence will be described with reference to FIG. 7B.

In a case where a new developing cartridge is inserted when the drum cartridge 210 is not new, it is necessary to finely adjust the quantity of the laser light in the coating agent removal sequence.

More specifically, when the toner supply pattern is divided into n areas, the development is performed (coating agent is removed) for the area corresponding to 1/n turn in each turn of the development roller 4, and the entire coating agent on the development roller 4 is removed during n turns of the development roller 4.

At this time, the control unit 101 calculates a time taken for a range in which the development is performed (coating agent is removed), and controls the light quantity of the laser light 35 to be 0 $\mu J/cm^2$ (a portion where the coating agent is not removed) and 0.4 $\mu J/cm^2$ (a portion where the coating agent is removed) based on the calculated timing.

As for the quantity of the laser light 35 in the coating agent removal sequence, the laser light 35 with a quantity larger than that in the process of image formation is radiated on the photosensitive drum 1, to thereby produce a latent image potential deeper than that in the process of image formation so that the coating agent formed on the development roller 4 can be effectively transferred onto the photosensitive drum 1.

In this manner, the amount of toner per unit time that enters the cleaning member is reduced by intermittently forming the toner supply pattern, thereby making it possible to maintain the stable cleaning performance while effectively removing (discharging) the coating agent from the developing apparatus.

In the present exemplary embodiment, the coating agent is removed using 11 turns of the development roller 4 with the entire surface of the development roller 4 divided into 10 areas.

The bias control and the laser scanning control described above with reference to FIGS. 7A and 7B are performed by the image forming unit 510 in relation to the control processing in step S7 by the control unit 101 that is executed based on the determination processing in step S6 described above with reference to FIG. 4. The coating agent that has been moved onto the surface of the photosensitive drum 1 by the operation illustrated in FIG. 5 is removed from the surface of the photosensitive drum 1 by the cleaning blade 6.

[Experiments]

To verify the above-described advantageous effects, the following verification experiments were conducted.

1. Confirmation of Advantageous Effects of the Present Exemplary Embodiment

<Verification Contents>

Under an environment of low-temperature and low-humidity conditions (at a temperature of 15° C. and a humidity of 10%), drum cartridges having respective driven amounts of 0% and 40%, and a developing cartridge having a driven amount of 0% were prepared, and the coating agent removal sequence corresponding to one turn of the development roller 4 was carried out using the combination of the cartridges. In this case, soiling of a charging roller due to a cleaning failure was confirmed. The amount of toner formed on the development roller 4 corresponds to a toner supply amount of 30 mg/one turn at 0.35 $mg/cm^2$.

In comparative example 1, the coating agent removal sequence was carried out using a combination of a drum cartridge having a driven amount of 0% (new) and a developing cartridge having a driven amount of 0% (new). In comparative example 2 and the first exemplary embodiment, the coating agent removal sequence was carried out using a combination of a drum cartridge having a driven amount of 40% (used) and a developing cartridge having a driven amount of 0% (new).

<Verification Result 1>

Table 6 illustrates a list of conditions and verification results. First, in comparative example 1, no cleaning failure occurred. This is considered to be because the drum cartridge is new and the cleaning performance of the drum cartridge is high.

TABLE 6

| | Drum cartridge use amount | Developing cartridge use amount | Process speed X | Discharge amount Y | Discharge pattern Z | Toner supply amount per unit time | Cleaning failure |
|---|---|---|---|---|---|---|---|
| Comparative Example 1 | 0% | 0% | 200 mm/s | 30 mg | not divided | 0.25 mg/ms | ○ |

TABLE 6-continued

| | Drum cartridge use amount | Developing cartridge use amount | Process speed X | Discharge amount Y | Discharge pattern Z | Toner supply amount per unit time | Cleaning failure |
|---|---|---|---|---|---|---|---|
| Comparative Example 2 | 40% | 0% | 200 mm/s | 30 mg | not divided | 0.25 mg/ms | X |
| First Exemplary Embodiment | 40% | 0% | 100 mm/s | 30 mg | divided into 10 areas | 0.0125 mg/ms | ○ |

Next, in comparative example 2, vertical streaks were caused by soiling of the charging roller due to a cleaning failure. This is because minute gaps are formed between the cleaning member and the drum due to an increase of scratches on the drum of the drum cartridge, and a large number of small-diameter coating agent particles and toner particles, which are present in a new cartridge, enter the gap. This causes the cleaning failure, which results in soiling of the charging roller and fogging (vertical streaks) due to a charging failure.

Next, in the first exemplary embodiment, no cleaning failure occurred. This may be because the process speed is decreased to ½ from 200 mm/s and the discharge pattern is divided into 10 areas, thereby reducing the toner supply amount per unit time on the cleaning member to 1/20 and thus facilitating cleaning.

As described above, by experiment 1, in the structure in which the drum cartridge 210 and the developing cartridge 200 described in the present exemplary embodiment are independently attachable to and detachable from the image forming apparatus 100, the toner supply amount per unit time in the coating agent removal sequence can be changed depending on the usage status of each cartridge. Therefore, the occurrence of a cleaning failure of the drum cartridge 210 can be suppressed while suppressing a density unevenness or a white spot caused by the coating agent of the developing cartridge 200.

In the present exemplary embodiment, the process speed and the discharge pattern are controlled. However, means for changing the amount of toner to be supplied to the cleaning member per unit time is not limited thereto. For example, the amount of toner to be supplied to the cleaning member per unit time may be changed, as indicated in Table 2, by controlling the density of the pattern to be increased or decreased while maintaining the pattern area (Z=1) constant.

As described above, when the image forming apparatus 100 has a structure in which the image-bearing member unit and the developing unit are independently attachable to and detachable from the main body of the image forming apparatus 100, the image forming apparatus 100 controls the coating agent discharge sequence depending on the drive status of each unit. Through this control, it is possible to suppress the occurrence of a cleaning failure in the image-bearing member unit while suppressing the occurrence of an image defect, such as a density unevenness or a white spot, due to the developing cartridge.

While the present invention has been described with reference to exemplary embodiments, it is to be understood that the invention is not limited to the disclosed exemplary embodiments. It will of course be understood that this invention has been described above by way of example only, and that modifications of detail can be made within the scope of this invention.

This application claims the benefit of Japanese Patent Application No. 2018-087521, filed Apr. 27, 2018, which is hereby incorporated by reference herein in its entirety.

What is claimed is:

1. An image forming apparatus including an image-bearing member unit and a developing unit that are attachable thereto and detachable therefrom, wherein the imaging bearing member unit comprising:

a rotatable image-bearing member on which an electrostatic latent image is formed;

a cleaning member configured to come into contact with the image-bearing member to remove developer from a surface of the image-bearing member; and a first memory configured to store information about a driven amount of the image-bearing member unit, wherein the developing unit comprises:

a developer bearing member configured to supply developer to the surface of the image-bearing member to develop the electrostatic latent image into a developer image, at least a part of the developer bearing member being coated with lubricant; and a second memory configured to store information about a driven amount of the developing unit, the image forming apparatus comprising:

a communication unit configured to read the information stored in the first memory and the information stored in the second memory; and a control unit configured to control execution of a coating agent removal sequence for removing the lubricant from the developer bearing member, the coating agent removal sequence being performed in a row without performing an image formation based on the image information input from an apparatus communicably connected to the image forming apparatus, wherein the control unit controls a developer supply amount per unit time supplied from the developer bearing member in the coating agent removal sequence based on the information about the driven amount of the image-bearing member unit acquired from the first memory via the communication unit, and the information about the driven amount of the developing unit acquired from the second memory via the communication unit.

2. The image forming apparatus according to claim 1, wherein the control unit is configured to reduce the developer supply amount per unit time in the coating agent removal sequence as the information about the driven amount of the image-bearing member unit acquired from the first memory indicates a larger cumulative driven amount.

3. The image forming apparatus according to claim 1, wherein the control unit is configured to increase a total developer supply amount in the coating agent removal sequence as the information about the driven amount of the developing unit acquired from the second memory indicates a larger cumulative driven amount, and the control unit is configured to reduce a degree of increase as the information about the driven amount of the image-bearing member unit acquired from the first memory indicates a larger cumulative driven amount.

4. The image forming apparatus according to claim 1, wherein the control unit is configured to perform control in such a manner that the developer supply amount per unit time in the coating agent removal sequence in a case where the image-bearing member unit is not new and the developing unit is new is smaller than the development supply amount per unit time in the coating agent removal sequence in a case where the image-bearing member unit is new and the developing unit is new.

5. The image forming apparatus according to claim 1, wherein the lubricant is charged to the same polarity as that of the developer, and an absolute value of a charge amount per unit mass of the lubricant is greater than an absolute value of a charge amount per unit mass of the developer.

6. The image forming apparatus according to claim 1, wherein the driven amount of the image-bearing member unit is determined based on the number of rotations of the image-bearing member.

7. The image forming apparatus according to claim 1, wherein the driven amount of the developing unit is determined based on the number of rotations of the developer bearing member.

8. The image forming apparatus according to claim 1, wherein the developer supply amount per unit time is expressed by $((k \times X) \div DL) \times (1/Z) \times y$ X denotes a process speed corresponding to a movement speed of the rotatable image-bearing member, K denotes a peripheral speed ratio defined as a ratio of a peripheral speed of the rotational image bearing member to a peripheral speed of the developer bearing member, DL denotes a length of one turn of the developer bearing member, Z denotes how many of areas obtained by dividing an entire surface of the developer bearing member correspond to an area in which a pattern of the developer is formed in one turn of the developer bearing member, and y denotes a supply amount of developer to be supplied in one turn of the developer bearing member.

9. An image forming apparatus including an image-bearing member unit and a developing unit that are attachable thereto and detachable therefrom, wherein the imaging bearing member unit comprising:

a rotatable image-bearing member on which an electrostatic latent image is formed;

a cleaning member configured to come into contact with the image-bearing member to remove developer from a surface of the image-bearing member; and wherein the developing unit comprises:

a developer bearing member configured to supply developer to the surface of the image-bearing member to develop the electrostatic latent image into a developer image, at least a part of the developer bearing member being coated with lubricant; and the image forming apparatus comprising:

a communication unit configured to aquire first information about a driven amount of the image bearing member unit and second information about a driven amount of the developing unit; and a control unit configured to control execution of a coating agent removal sequence for removing the lubricant from the developer bearing member, the coating agent removal sequence being performed in a row without an image formation based on the image information input from an apparatus communicably connected to the image forming apparatus, wherein the control unit controls a developer supply amount per unit time supplied from the developer bearing member in the coating agent removal sequence based on the first information about the driven amount of the image- bearing member unit acquired by the communication unit, and the second information about the driven amount of the developing unit acquired by the communication unit.

10. The image forming apparatus according to claim 9, wherein the control unit is configured to reduce the developer supply amount per unit time in the coating agent removal sequence as the information about the driven amount of the image-bearing member unit acquired by the communication unit indicates a larger cumulative driven amount.

11. The image forming apparatus according to claim 9, wherein the control unit is configured to increase a total developer supply amount in the coating agent removal sequence as the information about the driven amount of the developing unit acquired by the communication unit indicates a larger cumulative driven amount, and the control unit is configured to reduce a degree of increase as the information about the driven amount of the image-bearing member unit acquired by the communication unit indicates a larger cumulative driven amount.

12. The image forming apparatus according to claim 9, wherein the control unit is configured to perform control in such a manner that the developer supply amount per unit time in the coating agent removal sequence in a case where the image-bearing member unit is not new and the developing unit is new is smaller than the development supply amount per unit time in the coating agent removal sequence in a case where the image-bearing member unit is new and the developing unit is new.

13. The image forming apparatus according to claim 9, wherein the lubricant is charged to the same polarity as that of the developer, and an absolute value of a charge amount per unit mass of the lubricant is greater than an absolute value of a charge amount per unit mass of the developer.

14. The image forming apparatus according to claim 9, wherein the driven amount of the image-bearing member unit is determined based on the number of rotations of the image-bearing member.

15. The image forming apparatus according to claim 9, wherein the driven amount of the developing unit is determined based on the number of rotations of the developer bearing member.

16. The image forming apparatus according to claim 9, wherein the developer supply amount per unit time is expressed by $((k \times X) \div DL) \times (1/Z) \times y$ X denotes a process speed corresponding to a movement speed of the rotatable image-bearing member, K denotes a peripheral speed ratio defined as a ratio of a peripheral speed of the rotational image bearing member to a peripheral speed of the developer bearing member, DL denotes a length of one turn of the developer bearing member, Z denotes how many of areas obtained by dividing an entire surface of the developer bearing member correspond to an area in which a pattern of the developer is formed in one turn of the developer bearing member, and y denotes a supply amount of developer to be supplied in one turn of the developer bearing member.

17. An image forming apparatus including an image-bearing member unit and a developing unit that are attachable thereto and detachable therefrom, wherein the imaging bearing member unit comprising:

a rotatable image-bearing member on which an electrostatic latent image is formed;

a cleaning member configured to come into contact with the image-bearing member to remove developer from a surface of the image-bearing member; and wherein the developing unit comprises:

a developer bearing member configured to supply developer to the surface of the image-bearing member to develop the electrostatic latent image into a developer image, at least a part of the developer bearing member being coated with lubricant; and the image forming apparatus comprising:

a communication unit configured to acquire first information about a driven amount of the image bearing member unit and second information about a driven amount of the developing unit; and a control unit configured to control execution of a coating agent removal sequence for removing the lubricant from the developer bearing member, wherein the control unit controls a developer supply amount per unit time supplied from the developer bearing member in the coating agent removal sequence based on the first information about the driven amount of the image- bearing member unit acquired by the communication unit, and the second information about the driven amount of the developing unit acquired by the communication unit wherein the developer supply amount per unit time is expressed by $((k \times X) \div DL) \times (1/Z) \times y$ X denotes a process speed corresponding to a movement speed of the rotatable image-bearing member, K denotes a peripheral speed ratio defined as a ratio of a peripheral speed of the rotational image bearing member to a peripheral speed of the developer bearing member, DL denotes a length of one turn of the developer bearing member, Z denotes how many of areas obtained by dividing an entire surface of the developer bearing member correspond to an area in which a pattern of the developer is formed in one turn of the developer bearing member, and y denotes a supply amount of developer to be supplied in one turn of the developer bearing member.

* * * * *